US007895707B2

(12) United States Patent
Moon

(10) Patent No.: US 7,895,707 B2
(45) Date of Patent: Mar. 1, 2011

(54) HEIGHT ADJUSTING APPARATUS OF SUCTION BODY FOR USE IN VACUUM CLEANER

(75) Inventor: Joo-sung Moon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 1058 days.

(21) Appl. No.: 11/703,274

(22) Filed: Feb. 7, 2007

(65) Prior Publication Data

US 2008/0072398 A1 Mar. 27, 2008

(30) Foreign Application Priority Data

Sep. 25, 2006 (KR) ..... 10-2006-0092800

(51) Int. Cl.
*A47L 5/34* (2006.01)

(52) U.S. Cl. ..... 15/354; 15/355; 15/356

(58) Field of Classification Search ..... 15/354–356; *A47L 5/34*

See application file for complete search history.

(56) References Cited

U.S. PATENT DOCUMENTS 4,437,205 A 3/1984 Koland ..... 15/354

FOREIGN PATENT DOCUMENTS

GB 452405 8/1936
KR 1020010012060 2/2001

OTHER PUBLICATIONS

Office Action dated Apr. 23, 2007 corresponding to United Kingdom Patent Application No. 0703363.2.

*Primary Examiner*—David A Redding
(74) *Attorney, Agent, or Firm*—Ohlandt, Greeley, Ruggiero & Perle, LLP

(57) ABSTRACT

A height adjusting apparatus of a suction body for use in an upright vacuum cleaner is disclosed. The apparatus adjusts a distance between a rotary brush and a surface to be cleaned, and includes a lifting unit pivotably disposed to the suction body, and an actuating unit disposed in a modularized state at the rear of the suction body, so that a portion thereof is exposed to the outside from the suction body, and lifting or lowering the lifting unit as the portion thereof is repeatedly pushed by a user.

4 Claims, 7 Drawing Sheets

HEIGHT ADJUSTING APPARATUS OF SUCTION BODY FOR USE IN VACUUM CLEANER

CROSS-REFERENCE TO RELATED APPLICATIONS

This application claims the benefit under 35 U.S.C. §119(a) of Korean Patent Application No. 2006-0092800, filed on Sep. 25, 2006, in the Korean Intellectual Property Office, the entire disclosure of which is incorporated herein by reference.

BACKGROUND OF THE INVENTION

1. Field of the Invention

The present disclosure relates to an upright vacuum cleaner, and more particularly, to a height adjusting apparatus of a suction body, which can adjust a distance between a surface to be cleaned and a rotary brush installed in the suction body of the upright vacuum cleaner.

2. Description of the Related Art

Generally, an upright vacuum cleaner is provided with a rotary brush to remove dirt or stains. It is efficient that if a floor is being cleaned, the rotary brush is decreased in height, and if a carpet is being cleaned, the rotary brush is increased in height because it should rotate coming in close or proper contact with the floor or the carpet. Accordingly, the upright vacuum cleaner usually has a height adjusting apparatus capable of adjusting the height of the rotary brush.

Two known devices used as the height adjusting apparatus includes a knob type height adjusting apparatus, which has a knob installed on an upper part of a suction body that can be turned by a hand, and a pedal type height adjusting apparatus, which has a pedal projected outside the suction body that can be depressed with a foot. The knob type height adjusting apparatus is inconvenient to use because a user should bend her or his back to turn the knob installed on the upper part of the suction body. Accordingly, in recent, the pedal type height adjusting apparatus is popularly used.

However, the pedal type height adjusting apparatus is disadvantageous in that since the pedal is pushed at the rear of the suction body to adjust the height of the rotary brush located in front of the suction body, it has need of a lot of parts, which are operated in combination with a lever having the pedal, thereby being difficult to assemble and increasing the likelihood of problems. For instance, in case of a height adjusting apparatus of a suction body disclosed in Korean patent publication No. 2001-0012060, it requires to assemble a lot of parts together including a lever having a foothold, a spring to elastically support the lever and a spring holder therefor, an intermediate bracket, a rotating force-transmitting unit, a supporting unit having a cam, a contact end to come in contact with the cam.

Also, the pedal type height adjusting apparatus is disadvantageous in that when a force applied to the pedal is removed, it is frequent that a cam rotated is inversely rotated again, thereby deteriorating a reliability in height adjustment.

SUMMARY OF THE INVENTION

The present disclosure has been developed in order to solve the above problems in the related art. Accordingly, an aspect of the present disclosure is to provide a height adjusting apparatus of a suction body, which has a reduced number of parts, which is modularized to simplify a construction, and which is easy to assemble.

Another aspect of the present disclosure is to provide a height adjusting apparatus of a suction body capable of stably maintaining a height once adjusted, so that it is not changed if a pedal is not pushed again, thereby improving a reliability of product.

The above aspects are achieved by providing a height adjusting apparatus of a suction body for use in a upright vacuum cleaner capable of adjusting a distance between a rotary brush and a surface to be cleaned, including a lifting unit pivotably disposed to the suction body, and an actuating unit disposed in a modularized state at the rear of the suction body, so that a portion thereof is exposed to the outside from the suction body and lifting or lowering the lifting unit as the portion thereof is repeatedly pushed by a user. Accordingly, since the modularized actuating unit is assembled with the lifting unit, the apparatus can be easily and simply assembled, can simplify a construction and can reduce small problems.

Preferably, but not necessarily, the actuating unit includes a lever having a pedal pushable with a foot of the user, a cam wheel rotatably disposed and coming in cam contact with one end of the lifting unit at one side thereof, and a fixing bracket to which the lever and the cam wheel are mounted, and the lever, the cam wheel, and the fixing bracket are firmly assembled to one another to be mountable to and detachable from the suction body as a single body.

Also, preferably, but not necessarily, the fixing bracket has a stopper integrally formed therewith, so that the cam wheel is not inversely rotated, but fixed even though an external force is removed from the pedal. Accordingly, even though the external force applied to the lever is removed, the cam wheel cannot be inversely rotated, so that an adjusted height is stably maintained, thereby improving the reliability of product.

According to an exemplary embodiment of the present disclosure, the cam wheel may be configured to be rotated in one direction by a predetermined angle whenever the pedal of the lever exposed to the outside is pushed and then released, so that the lifting member pivots on a rear end thereof to lift or lower a front end thereof and to lift or lower a front part of the suction body.

Further, the cam wheel may be configured to have a plurality of hanging projections inclinedly projected in the same directions from a surface thereof coming in contact with the lever and arranged in the same intervals in a circle shape about a center thereof, respectively, and the lever may be configured to be rotatably joined to the fixing bracket along with the cam wheel, so that a center thereof is aligned with the center of the cam wheel, and to have at least one elastic projection formed in a direction corresponding to the inclined direction of the plurality of hanging projections on a surface thereof coming in contact with the cam wheel, so that in a repetitive pivoting motion of the lever, the elastic projection is snappishly and elastically engaged to one of the plurality of hanging projections to rotate the cam wheel only in one direction.

Also, the fixing bracket may be configured to include a stopper having a rear end fixed thereto and a front end forming a free end. In this case, the front end of the stopper may be inserted into one of a plurality of hanging grooves formed in the same intervals on a circumferential surface of the cam wheel to prevent the cam wheel from being rotated in a reverse direction, and may be elastically released from the inserted one of the plurality of hanging grooves when the cam wheel is pivoted in one direction.

Also, the lever may be configured to include an elastic bar extended downward at the front thereof and having an end tip elastically fixed to the front of the fixing bracket.

BRIEF DESCRIPTION OF THE DRAWING FIGURES

The above aspects and other advantages of the present disclosure will be more apparent by describing an embodiment of the present disclosure with reference to the accompanying drawing figures, in which.

In the drawing figures, it should be understood that like reference numerals refer to like features and structures.

DETAILED DESCRIPTION OF AN EXEMPLARY EMBODIMENT

Hereinafter, a height adjusting apparatus of a suction body according to an exemplary embodiment of the present disclosure will now be described in greater detail with reference to the accompanying drawing figures.

Figure 1A:
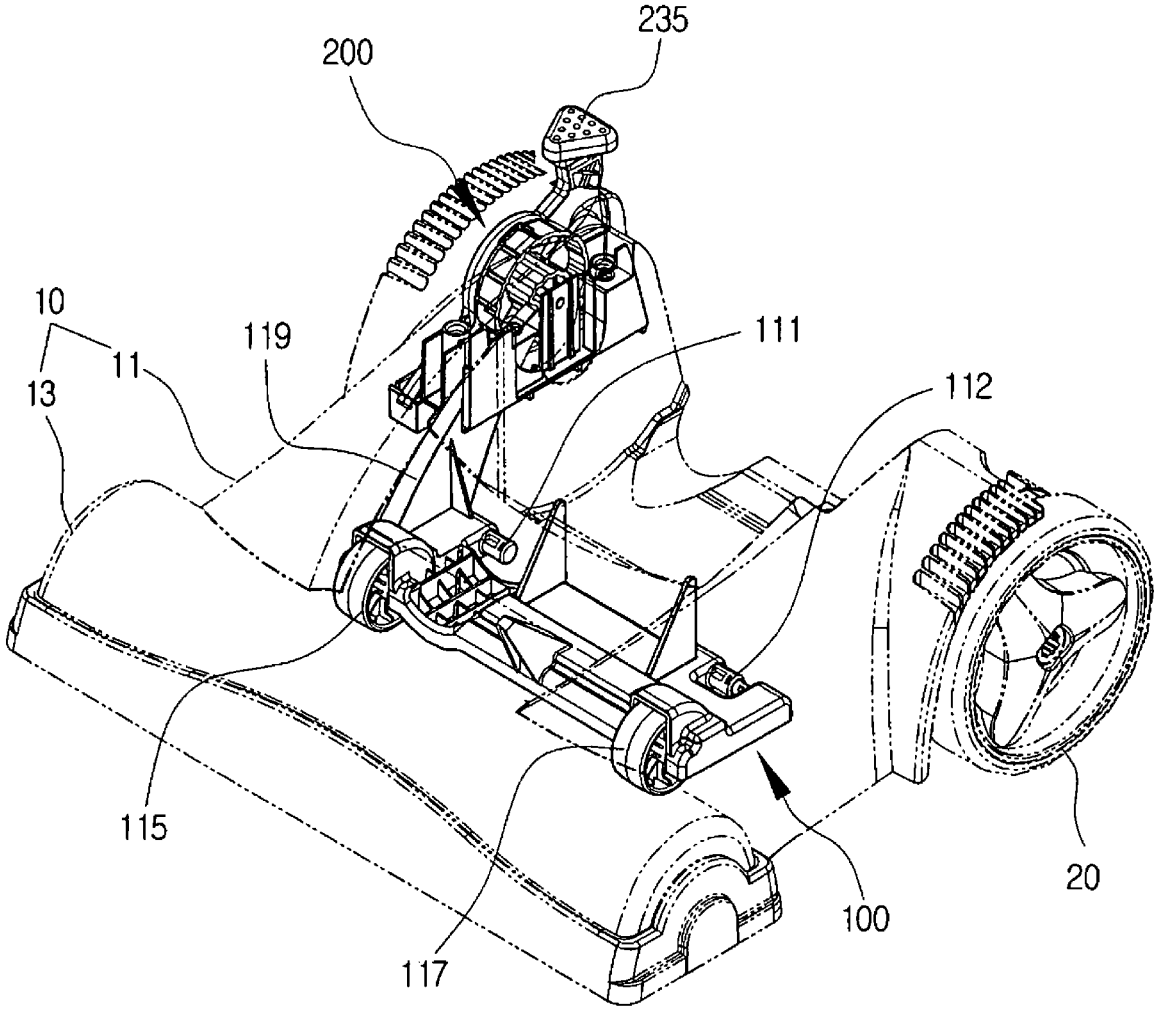
FIG. 1A is a perspective view exemplifying a state, which a height adjusting apparatus of a suction body according to an exemplary embodiment of the present disclosure is mounted in a suction body.

First, the suction body on which the height adjusting apparatus according to the exemplary embodiment of the present disclosure is mounted is described as follows with reference to the accompanying drawing figures. FIG. 1A is a perspective view exemplifying a state, which the height adjusting apparatus according to an exemplary embodiment of the present disclosure is mounted in the suction body, FIG. 1B is a perspective view exemplifying a connection relation between a fixing unit and an operating unit of the suction body illustrated in FIG. 1A, and FIG. 1C is a perspective view exemplifying a state, which a suction hose connected to the operating unit of the suction body of FIG. 1A is seated on the lifting unit.

Figure 1B:
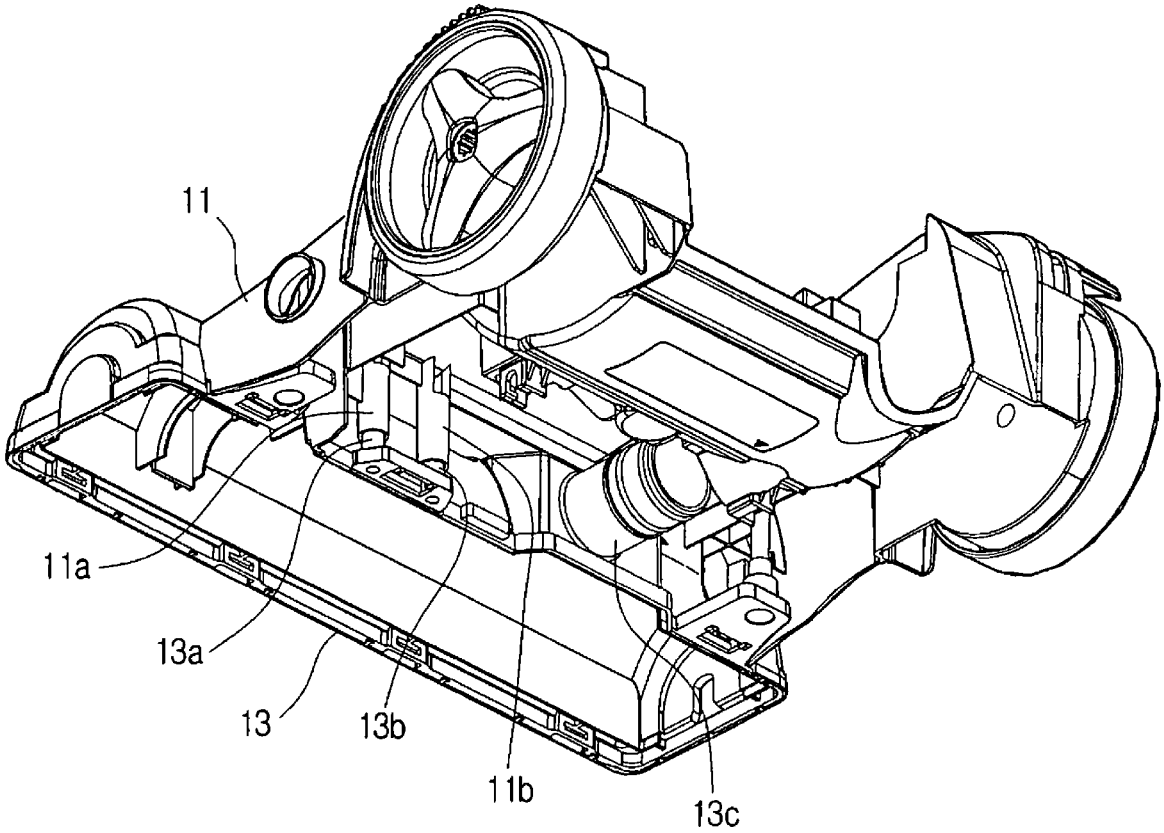
FIG. 1B is a perspective view exemplifying a connection relation between a fixing unit and an operating unit of the suction body illustrated in FIG. 1A.
Figure 1C:
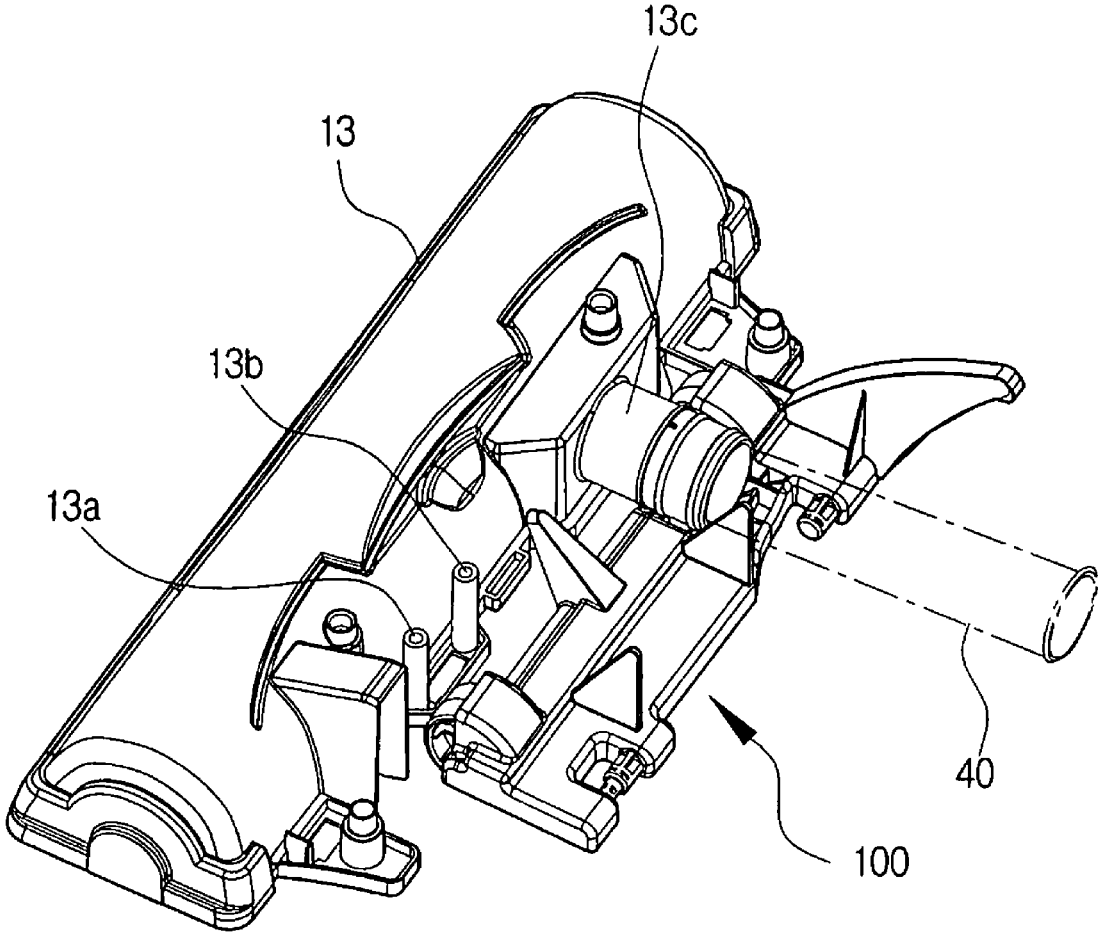
FIG. 1C is a perspective view exemplifying a state, which a suction hose connected to the operating unit of the suction body of FIG. 1A is seated on the lifting unit.

Referring to FIGS. 1A through 1C, the suction body 10 includes a fixing unit 11 and an operating unit 13. The fixing unit 11 is hingedly joined to a cleaner body (not illustrated) and has main wheels 20 connected to both sides thereof. The operating unit 13 has guide pins 13*a* and 13*b* (see FIG. 1C) slidably connected to guide tubes 11*a* and 11*b* (see FIG. 1B) of the fixing unit 11, so that it is joined to be ascendable and descendable to the fixing unit 11. In addition, the operating unit 13 has a rotary brush 30 (see FIG. 5) disposed in a horizontal direction therein. Also, the operating unit 13 has a neck part 13*c* formed at the rear thereof. To the neck part 13*c* is connected a suction hose 40, which communicates with a connecting tube (not illustrated) to take in dust and/or foreign substance brushed from a surface to be cleaned by the rotary brush 30 into the cleaner body.

Figure 2:
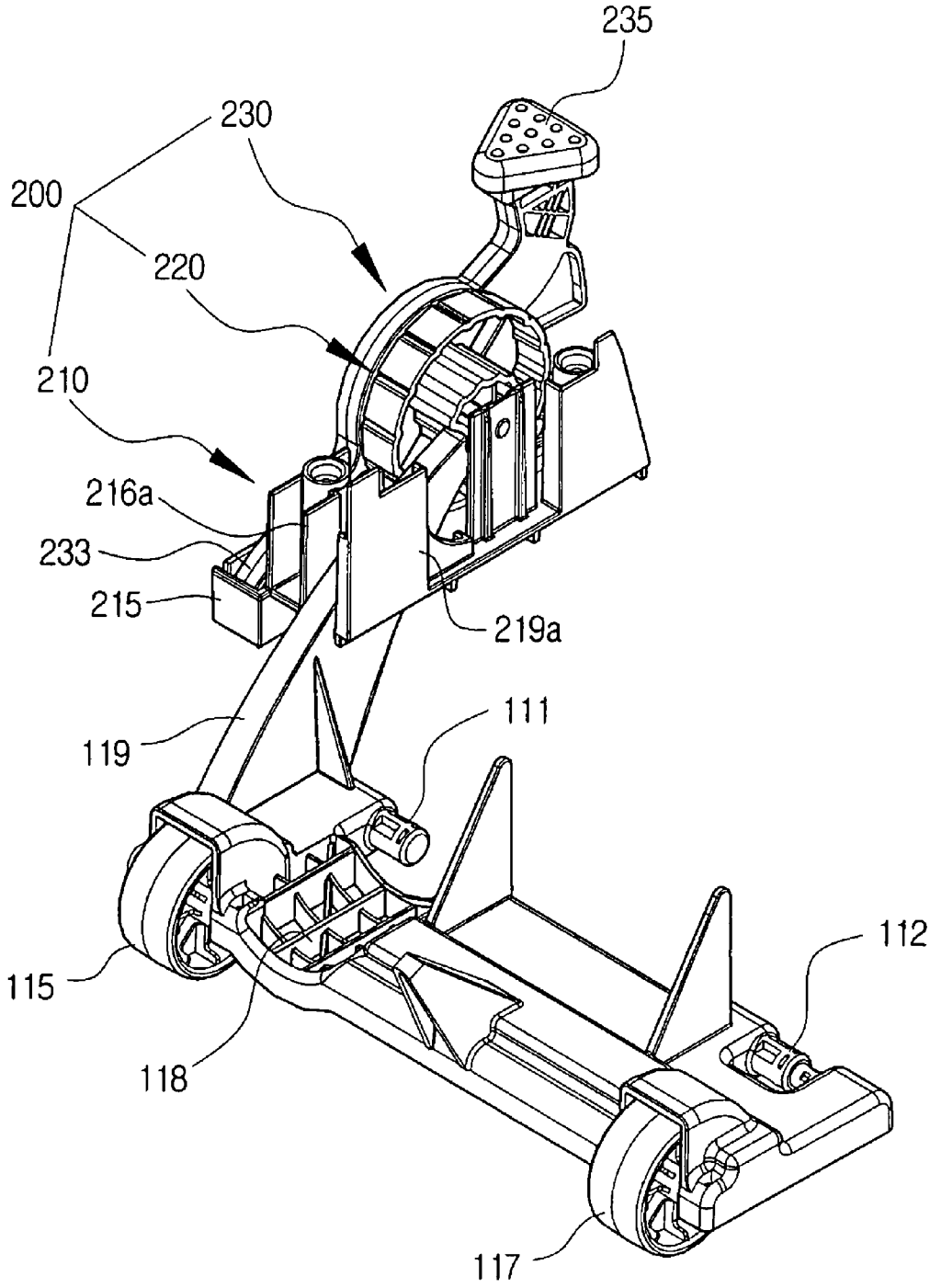
FIG. 2 is a perspective view exemplifying the height adjusting apparatus according to the exemplary embodiment of the present disclosure.
Figure 3:
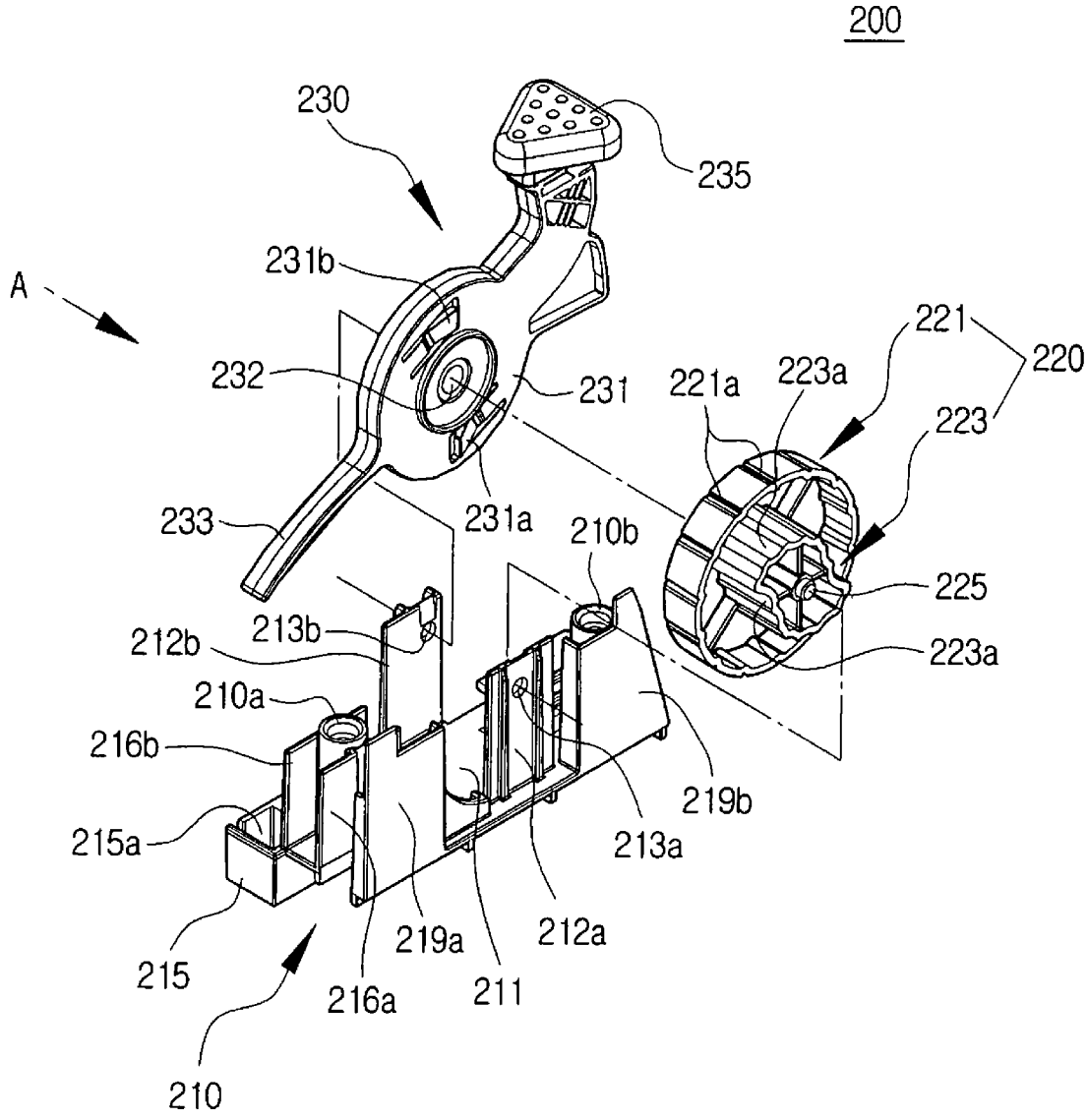
FIG. 3 is an exploded perspective view exemplifying an actuating unit of the height adjusting apparatus of FIG. 2.
Figure 4:
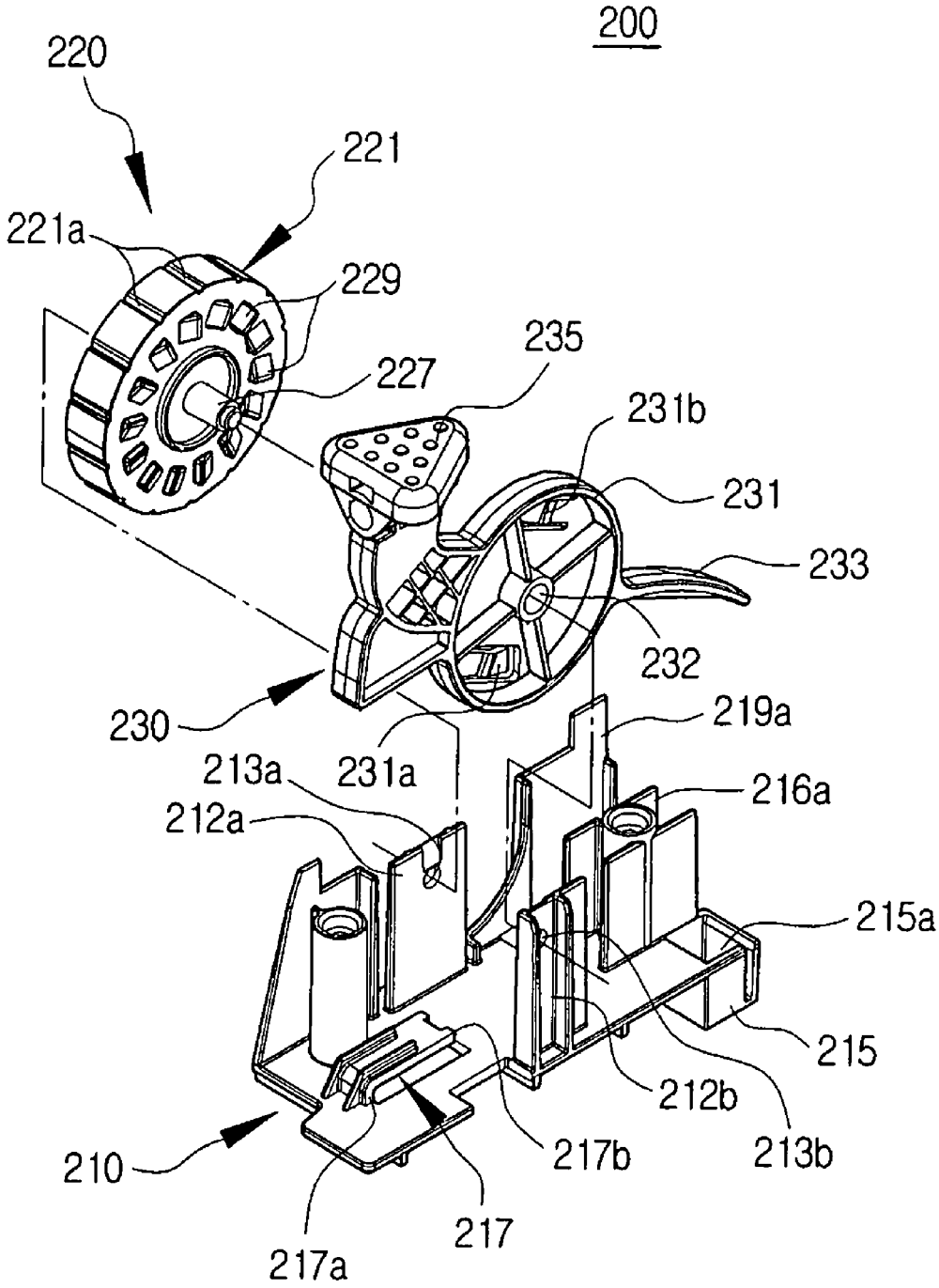
FIG. 4 is an exploded perspective view of the actuating unit viewed in a direction of arrow A of FIG. 3.

FIG. 2 is a perspective view exemplifying the height adjusting apparatus according to the exemplary embodiment of the present disclosure, FIG. 3 is an exploded perspective view exemplifying a modularized actuating unit of the height adjusting apparatus of FIG. 2, and FIG. 4 is an exploded perspective view of the actuating unit viewed in a direction of arrow A of FIG. 3.

As illustrated in FIG. 1A, the height adjusting apparatus of the suction body according to the exemplary embodiment of the present disclosure includes a lifting unit 100 and an actuating unit 200, which are mounted in the suction body 10.

As illustrated in FIG. 2, the lifting unit 100 is disposed, so that hinge axes 111 and 112 thereof are pivotably joined to a portion of the fixing unit 11 of the suction body 10. In addition, a pair of idle wheels 115 and 117 is rotatably disposed at a front end of the lifting unit 100 to smoothly move the suction body 10 when they reach the surface to be cleaned along with the pair of main wheels 20 joined to both sides of the fixing unit 11 in a state that the operating unit 13 is lowered (see FIG. 5). Further, when the front of the lifting unit 100 is lifted about the hinge axes 111 and 112 by an actuation of the actuating unit 200 as the suction hose 40 is seated on an seating groove 118, the lifting unit 100 acts to lift the operating unit 13 connected with the actuating unit 200 to a predetermined height. Also, the lifting unit 100 has an actuating bar 119 formed to come in cam contact with a cam wheel 220 of the actuating unit 200, so that it can be pivoted about the hinge axes 111 and 112. The actuating bar 119 is inclinedly extended in a rearward and upward direction of the lifting unit 100. Also, the actuating bar 119 is disposed, so that it is guided between a first sidewall 219*a* and a first rib 216*a*, as illustrated in FIG. 2.

The actuating unit 200 is formed of three members integrally assembled as a single body with one another. Accordingly, the actuating unit 200 can be installed to or detached from the suction body 10 as a whole by using fixing screws (not illustrated), which are screwed to a pair of boss 210*a* and 210*b* (see FIG. 3). Referring to FIGS. 2 through 4, the actuating unit 200 lifts or lowers the lifting unit 100 through a pedal 235 exposed to the outside from the suction body 10, and includes a fixing bracket 210, a cam wheel 220, and a lever 230.

The fixing bracket 210 is provided with a base plate 211, and a pair of supporting pieces 212*a* and 212*b*. The supporting pieces 212*a* and 212*b* are vertically disposed at both sides of the base plate 211 to rotatably support the cam wheel 220 and the lever 230. In addition, the fixing bracket 210 is provided with first and second sidewalls 219*a* and 219*b* and first and second rib 216*a* and 216*b*. The first and second sidewalls 219*a* and 219*b* are formed at one side of the fixing bracket 210 to which the first supporting piece 212*a* is disposed, and the first and second rib 216*a* and 216*b* are formed around the first boss 210*a*. Also, the fixing bracket 210 is provided with a projection part 215 having an inserting groove 215*a* extended and formed at the front thereof. An end tip of an elastic bar 233 of the lever 230 is elastically inserted into the inserting groove 215*a* as a little bent. The base plate 211 is provided with a stopper 217. The stopper 217 has a rear end 217*a* integrally joined to the rear of the base plate 211 and a front end 217*b* extended parallel to the base plate 211 from the rear end 217*a*. The front end 217*b* of the stopper 217 is inserted into hanging grooves 221*a* of a wheel unit 221 to firmly fix the cam wheel 220.

The cam wheel 220 is made up of a wheel unit 221 and a cam unit 223. The wheel unit 221 is provided with first and second axis projections 225 and 227 projected from both sides of a center thereof. The first axis projection 225 is rotatably inserted into and supported in a first joining hole 213*a* of the first supporting piece 212*a*, and the second axis projection 227 is rotatably inserted into and supported in a second joining hole 213*b* of the second supporting piece 212*b* through a penetrated hole 232 of the lever 230. The cam wheel 221 as described above has a plurality of hanging grooves 221*a* formed in the same intervals on a circumferential surface of the wheel unit 221 and engaged with the front end 217*b* of the stopper 217 of the fixing bracket 210 to prevent the cam wheel 220 from being rotated in a reverse direction. Accordingly, reliability deterioration in height adjustment, which is a problem in the conventional height adjusting apparatus, can be improved. Also, the cam unit 223 is projected from one side surface of the wheel unit 221 with surrounding the first axis projection 225 of the wheel unit 221, but projected less than the first axis projection 225. The cam unit 223 as described above is formed, so that a width in one direction passing through a center thereof is different from that in a direction approximately vertical to the one direction. For instance, the cam unit 223 is formed in the form of an Arabic numeral 8 as viewed from a side thereof, as illustrated in FIG. 3. On a circumferential surface of the cam unit 223 is formed a plurality of recesses 223*a* into or from which an end tip of the actuating bar 119 (see FIG. 2) is inserted or released. Also, the cam unit 223 has a plurality of hanging projections 229 inclinedly projected in the same directions from one surface of the wheel unit 221 coming in contact with the lever 230 and arranged in the same intervals in a circle shape about the second axis projection 227 of the cam wheel 220.

The lever 230 is provided with a center part 231 connected to the second axis projection 227 and rotatably joined to the first and the second supporting pieces 212*a* and 212*b* of the fixing bracket 210 along with the cam wheel 220. The center part 231 has a pair of elastic projections 231*a* and 231*b* inclinedly formed in a direction corresponding to the inclined direction of the plurality of hanging projections 229 of the cam wheel 220. In addition, the lever 230 is provided with an elastic bar 233 extended downward at the front of the center part 231. The elastic bar 233 has an end tip inserted into the inserting groove 215*a* formed in the projecting part 215 of the fixing bracket 210. In this case, the elastic bar 233 is formed to have a length larger than a length from the center part 231 to the front of the projecting part 215, so that the end of the elastic bar 233 is inserted into the inserting groove 215*a* with a slight bend, thus to elastically install the lever 230 to the fixing bracket 210. Accordingly, if a user pushes a pedal 235 extended and formed at the rear of the center part 231 in a clockwise direction and then releases it, the lever 230 is returned in an original position by a restoring force of the elastic bar 233 inserted into the inserting groove 215*a* as described above. That is, since a spring or other separate elastic member is not used, there is an effect in that the number of parts is reduced. At this time, when the lever 230 is rotated in the clockwise direction, the cam wheel 220 is rotated in the same angle as that of the lever because the elastic projections 231*a* and 231*b* and the hanging projection 229 are engaged and rotated with each other, whereas when the lever 230 is returned in the original position, is not returned because the elastic projections 231*a* and 231*b* and the hanging projection 229 are slipped to each other.

The height adjusting apparatus of the suction body according to the exemplary embodiment of the present disclosure constructed as described above is configured, so that the actuating unit 200 for lifting and lowering the lifting unit 100 is formed of a single module, that is, the cam wheel 220 and the lever 230 are mounted or detached in a state fixedly joined to the fixing bracket 210. Accordingly, the height adjusting apparatus is ease to install and can reduce the number of assembling processes, thereby reducing assembling costs. Also, the height adjusting apparatus can not only easily carry out a work, which mounts the modulated actuating unit 200 in a narrow space in the fixing unit 11, but also can greatly reduce the number of working processes and a working time.

Hereinafter, an operation of the height adjusting apparatus of the suction body constructed as described above will now be described in details with reference to the accompanying drawing figures.

Figure 5:
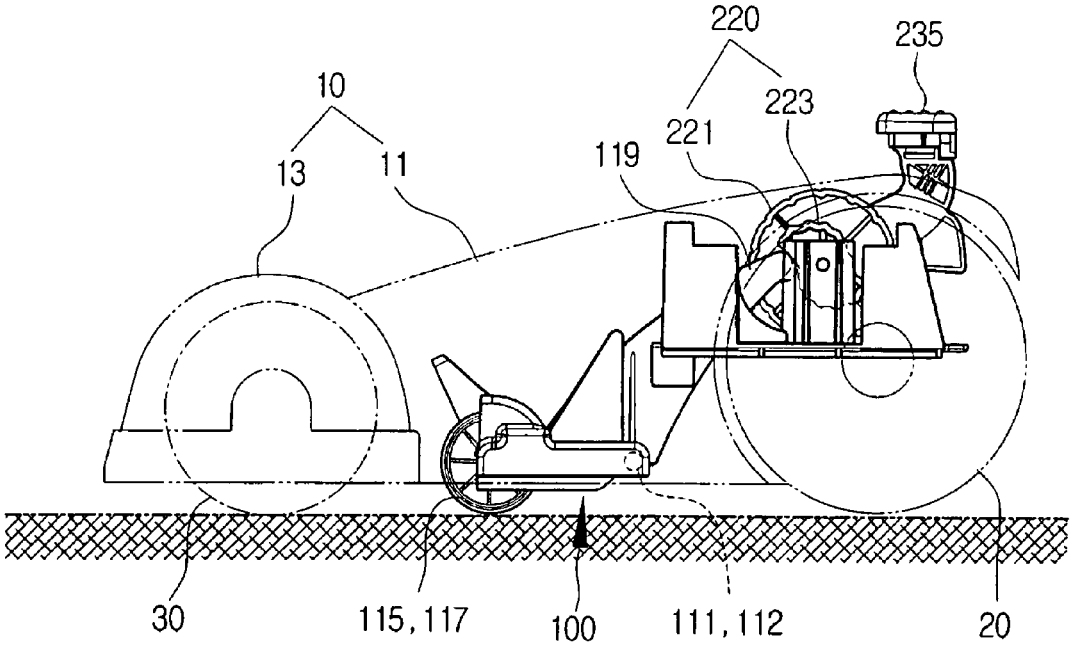
FIGS. 5 and 6 are schematic side elevation views exemplifying states where the operating unit of the suction body is lowered and lifted, respectively.

In the height adjusting apparatus of the suction body, if the operating unit 13 is in a state where to clean a surface to be cleaned, it is lowered to allow the rotary brush 30 to come in contact with the surface to be cleaned, the pair of idle wheels 115 and 117 joined to the lifting unit 100 reaches the surface to be cleaned along with the main wheel 20 thus to smoothly move the suction body, as illustrated in FIG. 5.

On the other hand, in case of cleaning a carpet or the like, the rotary brush 30 should be moved away from the surface to be cleaned. In this case, when a user repeatedly carries out an operation of pushing the pedal 235 with her or his foot and then releasing it, the operating unit 13 of the suction body 10 is lifted. The lifting operation of the operating unit 13 is carried out as follows.

When the user pushes the pedal 235 with her or his foot, the center part 231 (see FIG. 3) of the lever 230 is rotated in a clockwise direction by a predetermined angle, so that the cam wheel 220 is rotated in the clockwise direction in the same angle as that of the lever 230 by the pair of elastic projections 231*a* and 231*b* engaged with two hanging projections 229 out of the plurality of hanging projections 229 (see FIG. 4). At this time, the front end 217*b* of the stopper 217 (see FIG. 4) of the cam wheel 220 is inserted into the hanging groove 221*a* of the cam wheel 220 to prevent the cam wheel 220 from being rotated in a reverse direction (a counterclockwise direction). That is, the stopper 217, the cam wheel 220 and the lever 230 carry out an operation as that of a one way clutch in combination with one another. Meanwhile, when the cam wheel 220 is rotated in the predetermined angle, the end tip of the actuating bar 119 coming in cam contact with the cam unit 223 is pushed and thus the lifting unit 100 is pivoted in the clockwise direction by a predetermined angle about the hinge axes 111 and 112. According to this, the front of the lifting unit 100 is lifted to ascend the suction hose 40 (see FIG. 1C) seated on the lifting unit 100 to a predetermined height, and in combination with this, the operating unit 13 connected with the suction hose 40 is lifted to the predetermined height.

After that, when the user releases the pedal 235, the lever 230 is rotated in the counterclockwise direction by an elastic force generated by the elastic bar 233 (see FIG. 3) in the clockwise rotation thereof. At this time, the pair of elastic projections 231*a* and 231*b* of the lever 230 releases a snap coupling to the two hanging projections 229 out of the plurality of hanging projections 229 of cam wheel 220, which is restricted from being rotated in the counterclockwise direction, and is snappishly engaged to the next hanging projections 229 adjacent to the released two hanging projections 229 in the counterclockwise direction.

Figure 6:
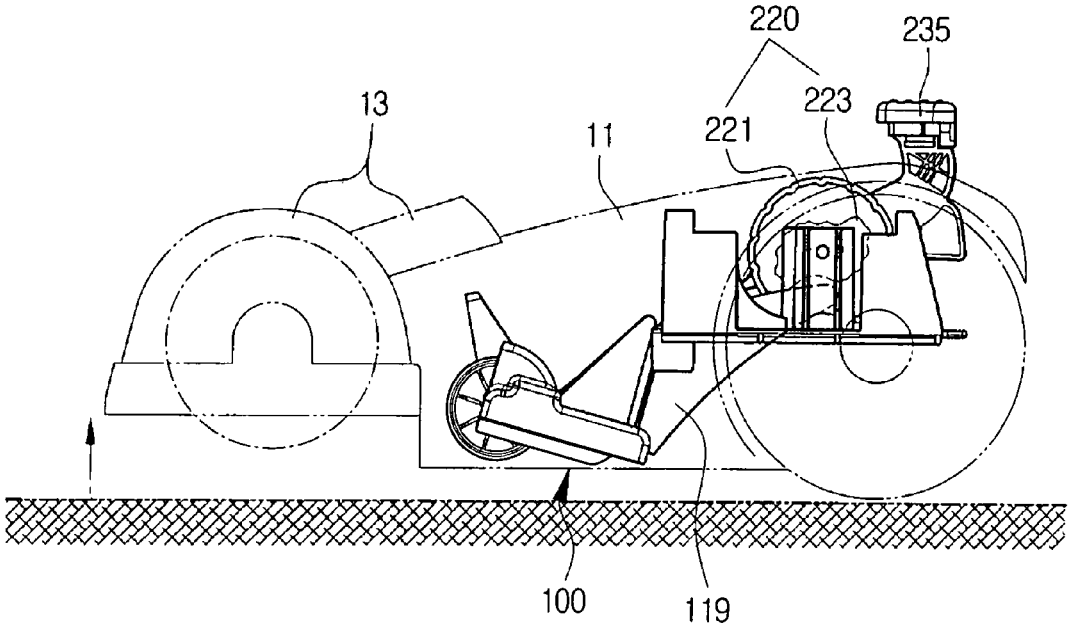

Thus, if the user repeatedly pushes and then releases the pedal 235, the actuating bar 119, which comes in contact with the cam unit 233, is operated to lift the operating unit 13 of the suction body 10 in the lowered state (see FIG. 5) to a maximum height (see FIG. 6). And if the user pushes and then releases the pedal 235 in succession again, the actuating bar 119 is operated to return the rotary brush 30 in a state where it comes in contact with the surface to be cleaned.

As apparent from the foregoing description, according to the exemplary embodiment of the present disclosure constructed as described above, the height adjusting apparatus of the suction body is configured, so that the actuating unit for lifting and lowering the lifting unit is not only fixedly assembled as a single body and thus mounted or detached as a whole, but also has no need of the separate elastic member, such as the spring, for returning the lever. Accordingly, the height adjusting apparatus according to the exemplary embodiment of the present disclosure can reduce the number of parts and facilitate assembling processes.

Further, the height adjusting apparatus of the suction body according to the exemplary embodiment of the present disclosure has a construction to prevent the cam wheel from being inversely rotated. Accordingly, the height adjusting apparatus according to the exemplary embodiment of the present disclosure can accurately adjust the height of the suction body, and ensure a liability of product.

Also, the height adjusting apparatus of the suction body according to the exemplary embodiment of the present disclosure can manage the actuating unit in terms of a single part, thereby being convenient to keep and handle the parts including the actuating unit.

The foregoing embodiment and advantages are merely exemplary and are not to be construed as limiting the present disclosure. The description of the present disclosure is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A height adjusting apparatus of a suction body for use in a upright vacuum cleaner capable of adjusting a distance between a rotary brush and a surface to be cleaned, comprising:

a lifting unit pivotably disposed to the suction body; and an actuating unit disposed at the rear of the suction body, so that a portion thereof is exposed to the outside from the suction body, and lifting or lowering the lifting unit as the portion thereof is repeatedly pushed by a user, wherein the actuating unit comprises a lever having a pedal pushable with a foot of the user, a cam wheel rotatably disposed and coming in cam contact with one end of the lifting unit at one side thereof, and a fixing bracket to which the lever and the cam wheel are mounted, and the lever, the cam wheel, and the fixing bracket are firmly assembled to one another to be mountable to and detachable from the suction body as a single body, wherein the fixing bracket has a stopper integrally formed therewith, so that the cam wheel is not inversely rotated, but fixed even though an external force is removed from the pedal, wherein the cam wheel has a plurality of hanging projections inclinedly projected in the same directions from a surface thereof coming in contact with the lever and arranged in the same intervals in a circle shape about a center thereof, respectively, and wherein the lever is rotatably joined to the fixing bracket along with the cam wheel, so that a center thereof is aligned with the center of the cam wheel, and has at least one elastic projection formed in a direction corresponding to the inclined direction of the plurality of hanging projections on a surface thereof coming in contact with the cam wheel, so that in a repetitive pivoting motion of the lever, the elastic projection is snappishly and elastically engaged to one of the plurality of hanging projections to rotate the cam wheel only in one direction.

2. The apparatus as claimed in claim 1, wherein the cam wheel is rotated in one direction by a predetermined angle whenever the pedal of the lever exposed to the outside is pushed and then released, so that the lifting member pivots on a rear end thereof to lift or lower a front end thereof and thus to lift or lower a front part of the suction body.

3. The apparatus as claimed in claim 1, wherein the fixing bracket comprises a stopper having a rear end fixed thereto and a front end forming a free end, and the front end of the stopper is inserted into one of a plurality of hanging grooves formed in the same intervals on a circumferential surface of the cam wheel to prevent the cam wheel from being rotated in a reverse direction, and is elastically released from the inserted one of the plurality of hanging grooves when the cam wheel is pivoted in one direction.

4. The apparatus as claimed in claim 1, wherein the lever comprises an elastic bar extended downward at the front thereof and having an end tip elastically fixed to the front of the fixing bracket.

* * * * *